US011196208B2

(12) United States Patent
Cho et al.

(10) Patent No.: US 11,196,208 B2
(45) Date of Patent: Dec. 7, 2021

(54) TERMINAL PROTECTION DEVICE OF CONNECTOR

(71) Applicants: HYUNDAI MOTOR COMPANY, Seoul (KR); KIA MOTORS CORPORATION, Seoul (KR); KYUNGSHIN CORP., Incheon (KR)

(72) Inventors: Jeong Min Cho, Suwon-si (KR); In Sic Kim, Incheon (KR); Jae Ho Park, Incheon (KR)

(73) Assignees: HYUNDAI MOTOR COMPANY, Seoul (KR); KIA MOTORS CORPORATION, Seoul (KR); KYUNGSHIN CORP., Incheon (KR)

( * ) Notice: Subject to any disclaimer, the term of this patent is extended or adjusted under 35 U.S.C. 154(b) by 0 days.

(21) Appl. No.: 16/904,961

(22) Filed: Jun. 18, 2020

(65) Prior Publication Data

US 2021/0028573 A1 Jan. 28, 2021

(30) Foreign Application Priority Data

Jul. 22, 2019 (KR) ..... 10-2019-0088472

(51) Int. Cl.
*H01R 13/453* (2006.01)

(52) U.S. Cl.
CPC ..... *H01R 13/453* (2013.01); *H01R 13/4538* (2013.01)

(58) Field of Classification Search
CPC ..... H01R 13/4538
See application file for complete search history.

(56) References Cited

U.S. PATENT DOCUMENTS 10,038,279 B2 * 7/2018 Suzuki ..... H01R 13/4538

* cited by examiner

*Primary Examiner* — Ross N Gushi
(74) *Attorney, Agent, or Firm* — McDonnell Boehnen Hulbert & Berghoff LLP

(57) ABSTRACT

The present disclosure relates to a terminal protection device of a connector capable of protecting a terminal from an external impact, thereby preventing deformation of the terminal, and an object of the present disclosure is to provide a terminal protection device of a connector capable of implementing a terminal protection structure using a conventional moving plate with a minimum configuration.

11 Claims, 17 Drawing Sheets

TERMINAL PROTECTION DEVICE OF CONNECTOR

CROSS-REFERENCE TO RELATED APPLICATION

This application claims under 35 U.S.C. § 119(a) the benefit of priority to Korean Patent Application No. 10-2019-0088472 filed on Jul. 22, 2019, the entire contents of which are incorporated herein by reference.

BACKGROUND

(a) Technical Field

The present disclosure relates to a terminal protection device of a connector, and more particularly, to a terminal protection device of a connector, which may protect a terminal from an external impact, thereby preventing deformation of the terminal.

(b) Background Art

Generally, a connector is used for wiring of electric parts provided in a vehicle. The connector may be used for interconnections between electrical wires or for connection between electrical wires and electric parts.

The connector is divided into a single-pole connector and a multi-pole connector according to the number of terminals. The multi-pole connector is mainly used for a connector for a vehicle. The multi-pole connector may be classified into a small-sized connector and a large-sized connector depending on its size.

A conventional multi-pole connector is composed of a male housing provided with a plurality of male terminals, and a female housing coupled to the male housing and provided with a plurality of female terminals. The female housing may be inserted into and coupled to the internal space of the male housing. The internal space of the male housing is formed to receive the female housing.

As the size of the multi-pole connector increases, the internal space of the male housing increases and as the internal space increases, the influence of the external force on the male terminal increases. Accordingly, in the case of the large-sized multi-pole connector, there is an increased possibility of deformation of the male terminal due to an external force. When the male terminal is deformed, the connection between the male housing and the female housing becomes difficult, and a failure of the connection between the male terminal and the female terminal may occur.

In order to solve these problems, a moving plate for protecting the male terminal has been applied. The moving plate covers and protects the terminal of the male housing until the female housing is inserted into the male housing. Further, when the female housing is inserted into the male housing, the moving plate moves with the female housing to enter the bottom of the male housing. Further, when the female housing is separated from the male housing, the moving plate moves with the female housing to return to a predetermined position in the male housing to cover and protect the male terminal.

In order to operate the moving plate as described above, not only the moving plate but also the male housing and the female housing are provided with the respective structures for supporting the operation of the moving plate. Specifically, the male housing and the female housing are provided with a structure for preventing the moving plate from be lowered arbitrarily and fixing the position of the moving plate, a structure for further entry of the moving plate in the male housing, a structure for returning the moving plate, and a structure for preventing the moving plate from further lifting and preventing the moving plate from being separated, respectively. As such a structure is provided in the male housing and the female housing, the size of the connector is increased. Accordingly, in the case of a small-sized multi-pole connector, it is difficult to protect the terminal by using the moving plate.

The above information disclosed in this Background section is only for enhancement of understanding of the background of the disclosure and therefore it may contain information that does not form the prior art that is already known in this country to a person of ordinary skill in the art.

SUMMARY

The present disclosure is intended to solve the above-described problems, and an object of the present disclosure is to provide a terminal protection device of a connector capable of implementing a terminal protection structure using a conventional moving plate with a minimum configuration.

Accordingly, a terminal protection device of a connector according to the present disclosure is configured to include a moving cover provided with a moving cover lock, and assembled at a predetermined position of a male housing to support male terminals disposed in a receiving space of the male housing; a male housing lock provided in the male housing, and for preventing the moving cover from being moved in the insertion direction of a female housing at a predetermined position by supporting the moving cover lock when the female housing is not inserted into the receiving space; and a female housing lock provided in the female housing, and for releasing that the movement of the moving cover is prevented by the male housing lock by separating the moving cover lock from the male housing lock when the female housing is inserted into the receiving space, and the moving cover lock is locked to the female housing lock to be moved with the female housing lock when the female housing is separated from the receiving space, such that the moving cover returns to the predetermined position.

According to an embodiment of the present disclosure, the moving cover may be configured to include a moving plate provided with a plurality of through holes that the male terminals penetrate; and a moving cover lock provided in the moving plate, and contacting the top horizontal surface of the male housing lock when the moving plate is disposed at a predetermined position. Further, the moving cover lock may include a first lock member formed integrally on the moving plate; and a second lock member formed integrally on the moving plate, and disposed in line with the first lock member, and the female housing may be pushed by the female housing lock entering between the first lock member and the second lock member when being inserted into the receiving space, such that the first lock member and the second lock member may be separated from the top horizontal surface of the male housing lock.

Specifically, the first lock member may be provided with a first inclined surface pushed while contacting the bottom portion of the female housing lock when the female housing is inserted into the receiving space, and the second lock member may be provided with a second inclined surface pushed while contacting the bottom portion of the female housing lock when the female housing is inserted into the receiving space.

Further, the first lock member may be provided with a first latching part to which the top horizontal surface of the female housing lock is latched when the female housing is separated from the receiving space, and the first latching part may be disposed below the first upper inclined surface with respect to the insertion direction of the female housing. The second lock member may be provided with a second latching part to which the top horizontal surface of the female housing lock is latched when the female housing is separated from the receiving space, and the second latching part may be disposed below the second upper inclined surface with respect to the insertion direction of the female housing.

Further, the first lock member may be provided with a first bottom horizontal surface locked to the top horizontal surface of the male housing lock when the female housing is not inserted into the receiving space, and the second lock member may be provided with a second bottom horizontal surface locked to the top horizontal surface of the male housing lock when the female housing is not inserted into the receiving space.

Further, the first lock member may be provided with a first lower inclined surface pushed by contacting the top horizontal surface of the female housing lock when the female housing is separated from the receiving space, and the first lower inclined surface may be disposed below the first latching part. The second lock member may be provided with a second lower inclined surface pushed by contacting the top horizontal surface of the female housing lock when the female housing is separated from the receiving space, the second lower inclined surface may be disposed below the second latching part, and the second lower inclined surface may be pushed in the direction opposite to the first lower inclined surface.

Further, according to an embodiment of the present disclosure, the first bottom horizontal surface is disposed close to the inside surface of the male housing of the inside surface of the male housing and the outside surface of the female housing to contact the male housing lock protruded to the inside surface of the male housing and not to contact the female housing lock protruded to the outside surface of the female housing with respect to a thickness direction of the first lock member. Further, the second bottom horizontal surface is disposed close to the inside surface of the male housing of the inside surface of the male housing and the outside surface of the female housing to contact the male housing lock protruded to the inside surface of the male housing and not to contact the female housing lock protruded to the outside surface of the female housing with respect to the thickness direction of the second lock member. Further, the first inclined surface, the first latching part, and the first inclined surface are disposed close to the outside surface of the female housing of the inside surface of the male housing and the outside surface of the female housing to contact the female housing lock protruded to the outside surface of the female housing and not to contact the male housing lock protruded to the inside surface of the male housing with respect to the thickness direction of the first lock member. Further, the second inclined surface, the second latching part, and the second inclined surface are disposed close to the outside surface of the female housing of the inside surface of the male housing and the outside surface of the female housing to contact the female housing lock protruded to the outside surface of the female housing and not to contact the male housing lock protruded to the inside surface of the male housing with respect to the thickness direction of the second lock member.

Further, according to an embodiment of the present disclosure, the inside surface of the male housing may be provided with a separation preventing projection, and a separation preventing bar locked to the separation preventing projection when the moving cover returns to a predetermined position may be provided at the edge of the moving plate.

Further, the top portion of the female housing lock may be provided with an extension having the width larger than that of the bottom portion of the female housing lock, and the extension may be locked between the first lock member and the second lock member by an elastic restoring force of the first lock member and the second lock member bent by being pushed by the bottom portion of the female housing lock when the female housing is inserted into the receiving space.

According to the terminal protection device of the connector according to the present disclosure, it is possible to implement the terminal protection structure using the conventional moving plate with a minimum configuration, thereby minimizing an increase in the size of the connector by the terminal protection structure, and accordingly, it may be applied to not only a large-sized multi-pole connector but also a small-sized multi-pole connector.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuels derived from resources other than petroleum). As referred to herein, a hybrid vehicle is a vehicle that has two or more sources of power, for example both gasoline-powered and electric-powered vehicles.

The above and other features of the disclosure are discussed infra.

BRIEF DESCRIPTION OF THE DRAWINGS

The above and other features of the present disclosure will now be described in detail with reference to certain exemplary embodiments thereof illustrated the accompanying drawings which are given hereinbelow by way of illustration only, and thus are not limitative of the present disclosure, and wherein.

Figure 5:
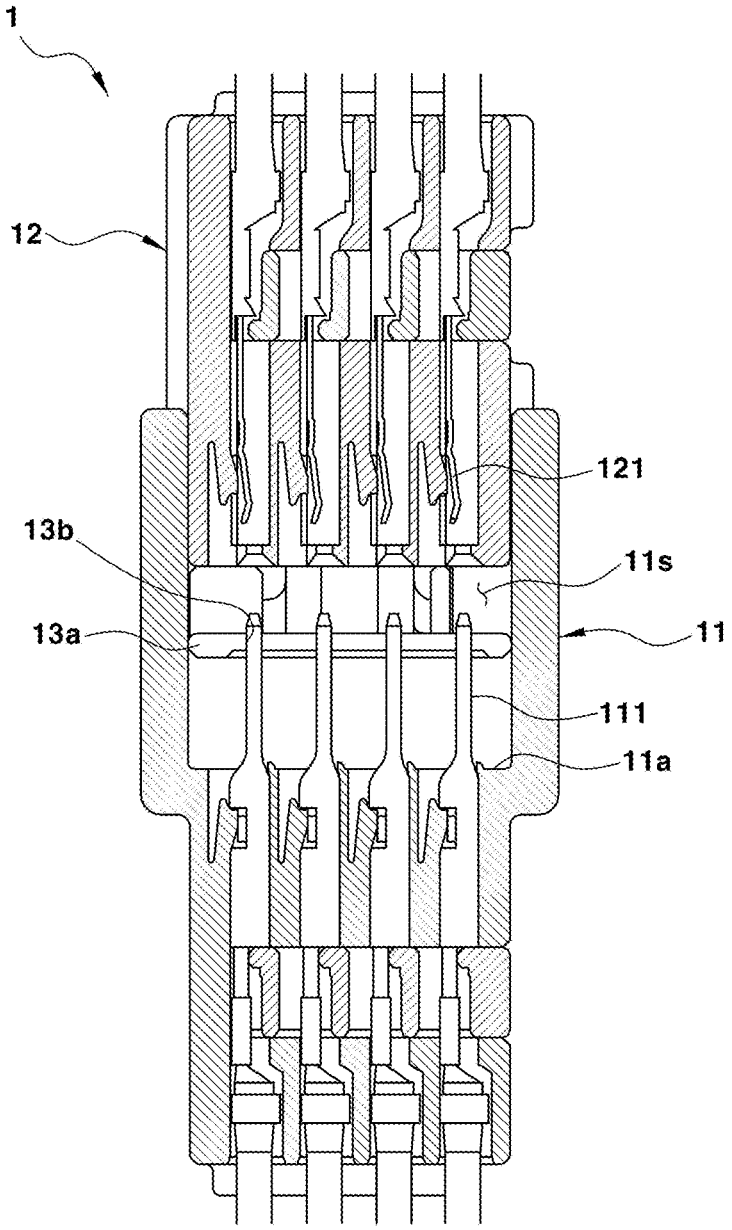
FIG. 5 is a diagram showing a state just before a male terminal and a female terminal according to the present disclosure are coupled to each other.
Figure 6:
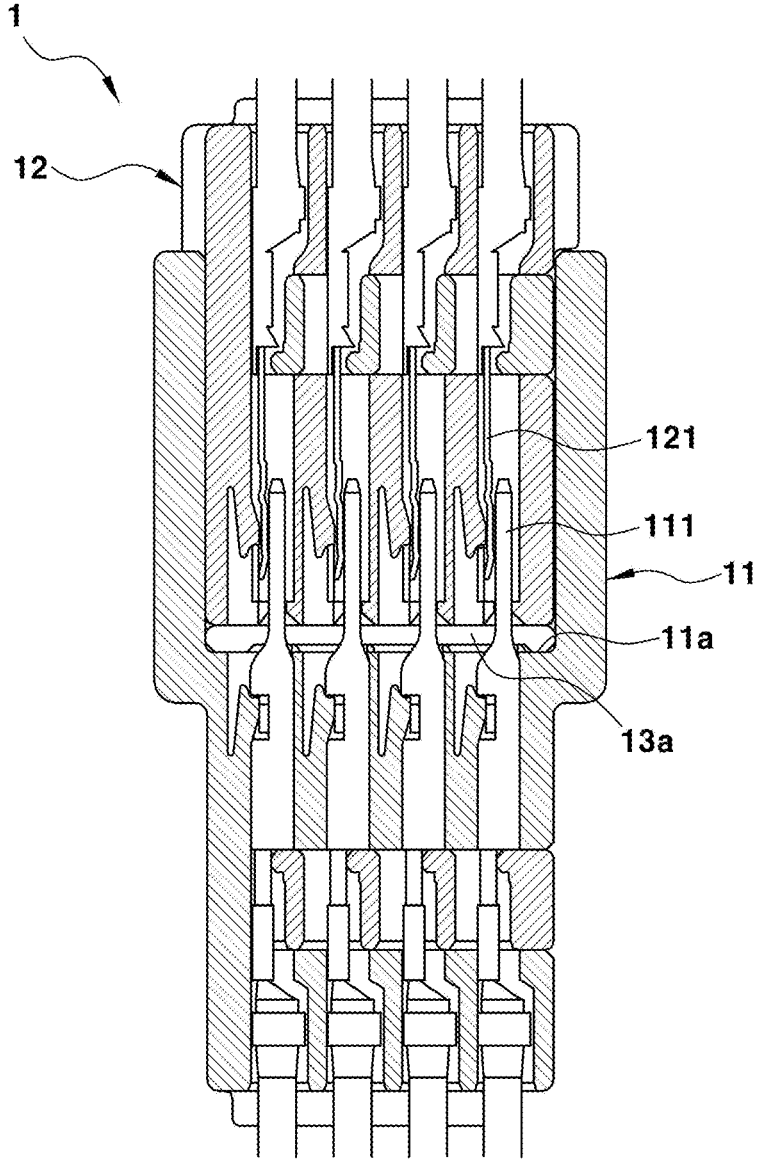
FIG. 6 is a diagram showing a state where the male terminal and the female terminal according to the present disclosure have been coupled to each other.
Figure 7:
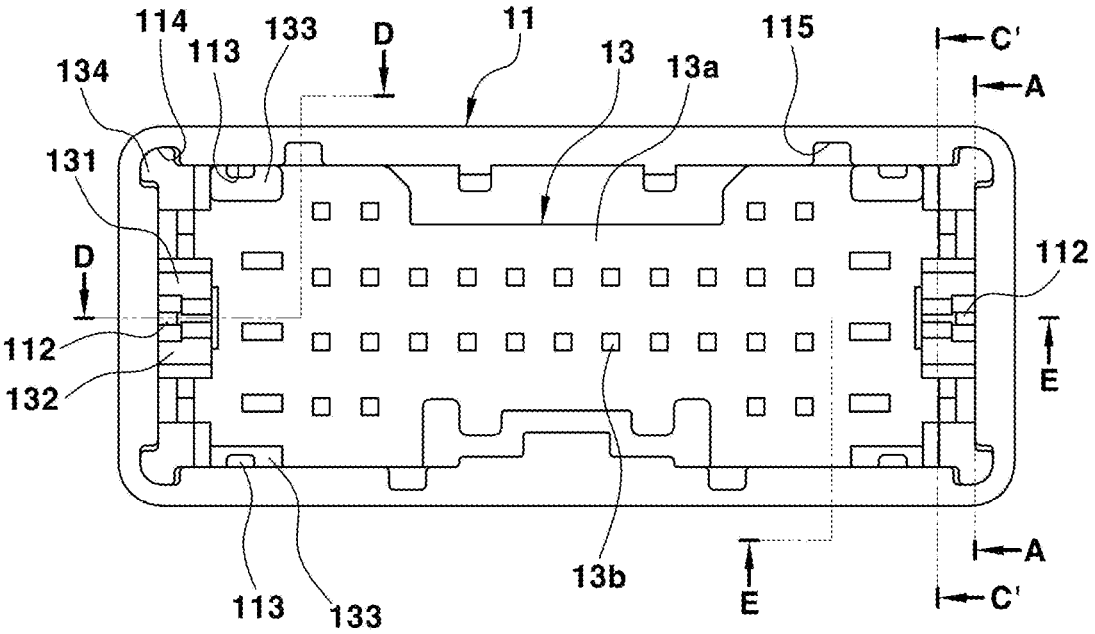
FIG. 7 is a plane diagram showing a male housing in which a moving cover has been assembled.
Figure 8:
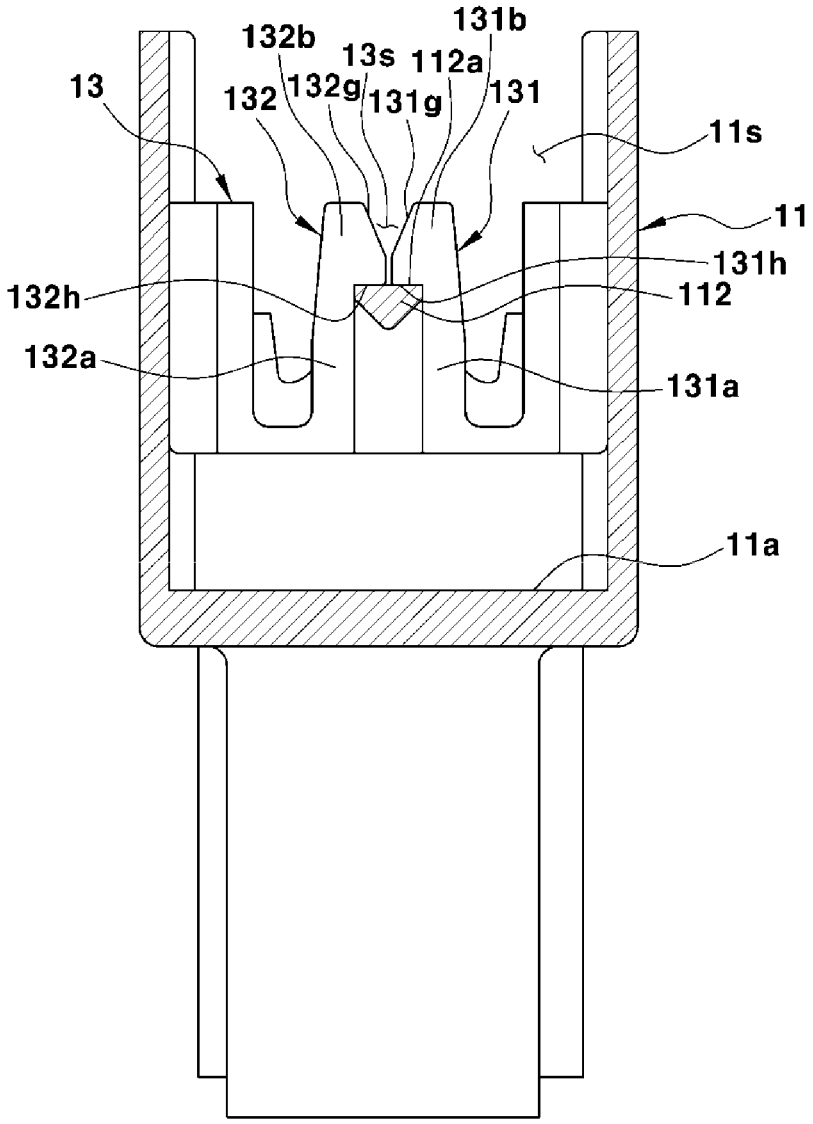
FIG. 8 is a diagram viewing from the line A-A of FIG. 7.

Further, the drawings except for FIGS. 5 and 6 are diagrams having omitted the male terminal and the female terminal.

It should be understood that the appended drawings are not necessarily to scale, presenting a somewhat simplified representation of various preferred features illustrative of the basic principles of the disclosure. The specific design features of the present disclosure as disclosed herein, including, for example, specific dimensions, orientations, locations, and shapes will be determined in section by the particular intended application and use environment.

In the drawings, reference numbers refer to the same or equivalent sections of the present disclosure throughout the several figures of the drawing.

DETAILED DESCRIPTION

Hereinafter, the present disclosure will be described so that those skilled in the art may easily practice it.

Figure 1:
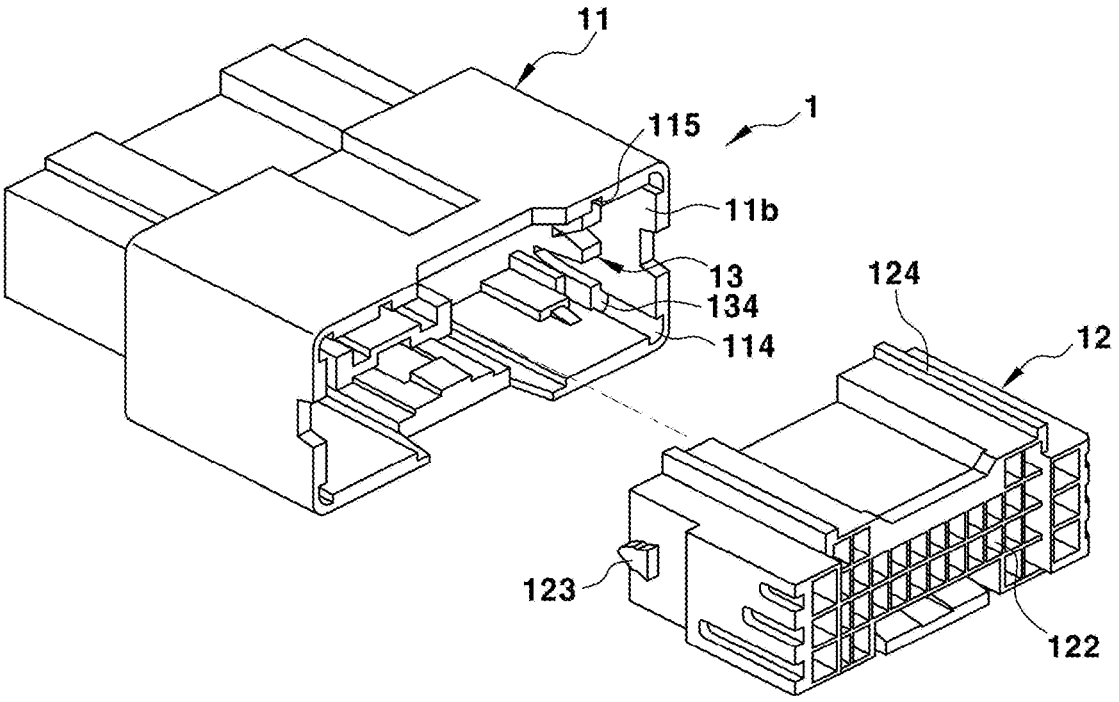
FIG. 1 is an exploded perspective diagram showing a connector according to the present disclosure.

Referring to FIG. 1, a connector 1 according to an embodiment of the present disclosure is configured to include a male housing 11 in which a moving cover 13 is assembled and a female housing 12 coupled to the male housing 11.

Referring to FIGS. 1, 2 and 5 to 9, the male housing 11 is provided with a receiving space 11*s* into which the female housing 12 may be inserted, and is provided with a plurality of male terminals 111 disposed in the receiving space 11*s*. The connection portion of the male terminal 111 may be protruded from the bottom surface 11*a* of the male housing 11 to be disposed in the receiving space 11*s*. The connection portion of the male terminal 111 may be connected with a female terminal 121. A portion excluding the connection portion of the male terminal 111 may be assembled to be fixed in the male housing 11.

The receiving space 11*s* is a space surrounded by the bottom surface 11*a* and the inside surface 11*b* of the male housing 11. That is, one side surface of the receiving space 11*s* is opened so that the female housing 12 may be inserted. That is, the top surface of the male housing 11 is open. For example, the top surface of the male housing 11 may be opened in a substantially rectangular shape. The top surface and the bottom surface 11*a* of the male housing 11 may be arranged in a straight line with respect to a direction in which the female housing 12 is inserted into the receiving space 11*s*.

The female housing 12 may be inserted into the receiving space 11*s* to be mutually coupled with the male housing 11. The female housing 12 may be inserted into the receiving space 11*s* to enter the bottom surface 11*a* of the male housing 11. The female housing 12 may be a block-like structure having a plurality of terminal holes 122 perforated therein. A female terminal 121 may be inserted and disposed for each terminal hole 122. Accordingly, the female housing 12 may be penetrated by a plurality of female terminals 121. The connection portion of the female terminal 121 may be disposed in the terminal hole 122 and a portion excluding the connection portion of the female terminal 121 may be protruded to the outside of the terminal hole to be disposed outside the female housing 12.

When the male housing 11 and the female housing 12 are coupled to each other, the connection portion of the male terminal 111 is inserted into and contacts the connection portion of the female terminal 121, and the male terminal 111 and the female terminal 121 are connected to each other. The connection portion of the female terminal 121 may be configured so that the connection portion of the male terminal 111 may be inserted.

Since the top surface of the male housing 11 is opened, the male terminal 111 may be deformed by an impact applied from outside or easily contaminated by foreign substances, before the female housing 12 is coupled to the male housing 11.

Referring to FIGS. 3, and 5 to 9, the moving cover 13 may be configured to be assembled in the male housing 11 to protect and support the connection portion of the male terminal 111. For example, when the female housing 12 is not inserted into the receiving space 11*s*, the moving cover 13 may be disposed at the end of the connection portion of the male terminal 111, thereby preventing deformation and contamination of the male terminal 111. For this purpose, the moving cover 13 may be configured to include a plate-shaped moving plate 13*a* inserted into and disposed in the receiving space 11*s*. The moving plate 13*a* is provided with a plurality of through holes 13*b* that the male terminals 111 may penetrate. The moving plate 13*a* may support the male terminals 111 fitted by the plurality of through holes 13*b*, thereby protecting them from an external impact. When the moving cover 13 is assembled to the male housing 11, the moving plate 13*a* may be disposed at a predetermined position (i.e., a right position) of the receiving space 11*s*. That is, the moving plate 13*a* may be disposed at the right position corresponding to a certain height in the receiving space 11*s*. For this purpose, the moving cover 13 may be configured to include a pair of moving cover locks 13*c*.

The pair of moving cover locks 13*c* may be disposed on both side edges of the moving plate 13*a*. When the moving plate 13*a* is disposed at the right position, the moving cover lock 13*c* may prevent the moving plate 13*a* from moving from the right position toward the bottom surface 11*a* of the male housing 11. That is, the moving cover lock 13*c* may prevent the moving cover 13 from being slid toward the bottom surface 11*a* of the male housing 11 arbitrarily. That is, when the female housing 12 is not coupled with the male housing 11, the moving cover 13 is prevented from being lowered toward the bottom surface of the male housing 11 by an external force regardless of the user's intention. This moving cover lock 13*c* may be supported by the male housing lock 112, thereby preventing the moving cover 13 from being arbitrarily lowered.

The male housing lock 112 may be provided on the inside surface of the male housing 11. The male housing lock 112 may be protruded at a certain thickness from the inside surface of the male housing 11 to support the lower horizontal surfaces 131*h*, 132*h* of the moving cover lock 13*c*. That is, the moving cover lock 13*c* may be locked and supported in the form of being stacked on the top horizontal surface 112*a* of the male housing lock 112. The bottom horizontal surfaces 131*h*, 132*h* of the moving cover lock 13*c* and the top horizontal surface 112*a* of the male housing lock 112 may be horizontal surfaces disposed perpendicularly to the insertion direction of the female housing 12.

When the female housing 12 is inserted into the male housing 11, the function of the moving cover lock 13*c* and the male housing lock 112 of preventing the moving cover 13 from being lowered by opening the moving cover lock 13*c* to both sides of the male housing lock 112 by a female housing lock 123 may be released. That is, an operation of the moving cover lock 13*c* may be released by the female housing lock 123. When the operation of the moving cover lock 13*c* is released, the moving cover lock 13*c* may be detached and separated from the top horizontal surface 112*a* of the male housing lock 112 while being opened to both sides of the male housing lock 112. Accordingly, when the moving cover lock 13*c* is opened to both sides of the male housing lock 112, the moving cover 13 may become a state that may be lowered to the bottom surface 11*a* of the male housing 11. When the moving cover lock 13*c* is opened to both sides of the male housing lock 112, the moving cover 13 may be lowered together with the female housing 12 by the female housing lock 123.

The moving cover lock 13*c* may be configured to include a pair of lock members 131, 132 provided at the edge of the moving plate 13*a*. The pair of lock members 131, 132 may be a first lock member 131 and a second lock member 132 formed integrally with the moving plate 13*a*, and the second lock member 132 may be disposed in a line by facing the first lock member 131. The first lock member 131 and the second lock member 132 may be formed to have a certain length from the edge of the moving plate 13*a* with respect to the sliding direction of the moving plate 13*a* in the male housing 11.

The moving cover 13 including the first lock member 131 and the second lock member 132 may be made of a material that is elastically deformed. For example, the moving cover 13 may be made of plastic.

Referring to FIGS. 9 to 13, when the female housing 12 is inserted into the male housing 11, the female housing lock 123 enters between the first lock member 131 and the second lock member 132, and the first lock member 131 and the second lock member 132 are bent to be opened to both sides of the male housing lock 112 by the female housing lock 123. As the first lock member 131 and the second lock member 132 are pushed by the female housing lock 123 to be opened to both sides of the male housing lock 112, the first lock member 131 and the second lock member 132 are detached and separated from the top horizontal surface 112*a* of the male housing lock 112.

Figure 9:
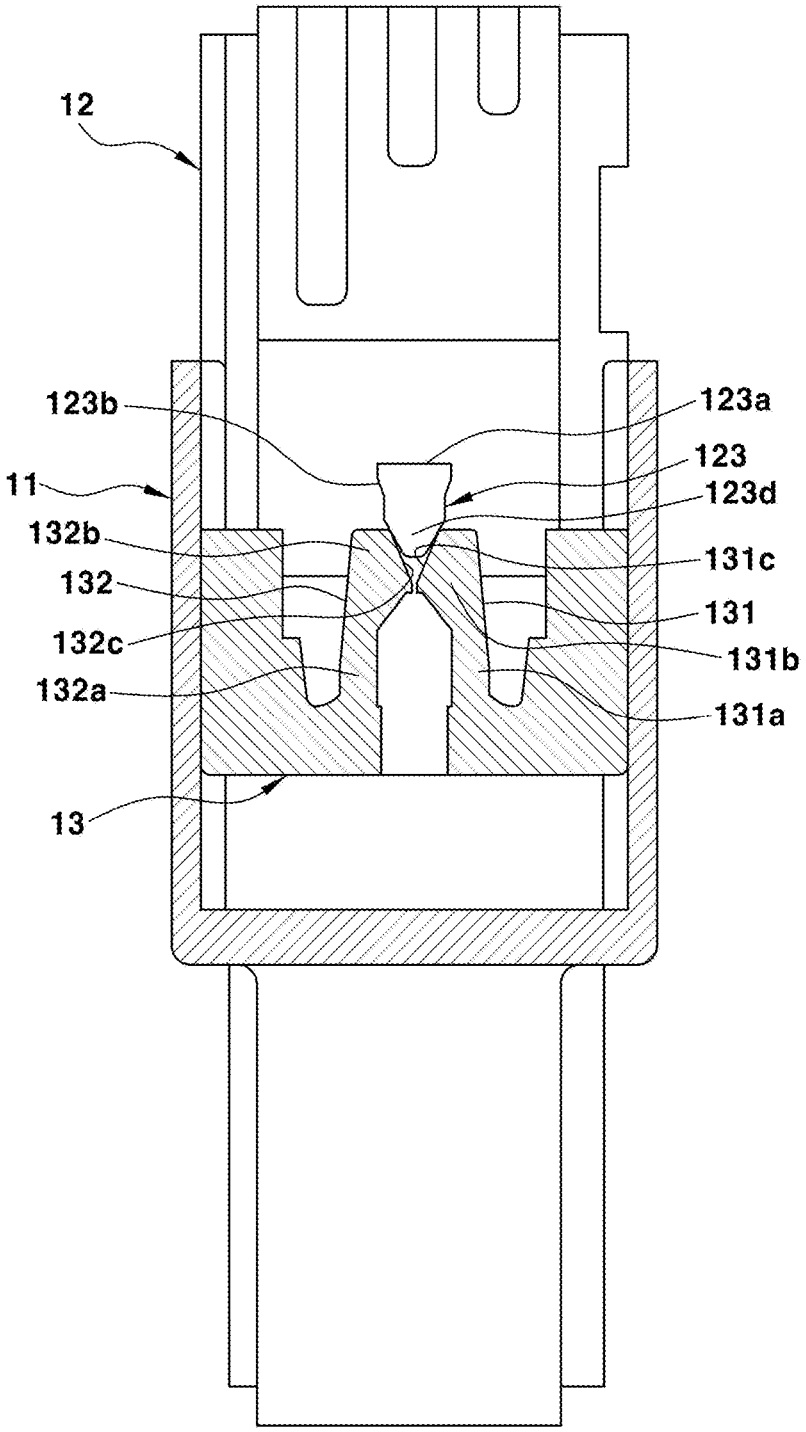
FIG. 9 is a diagram viewing from the line B-B of FIG. 4.
Figure 10:
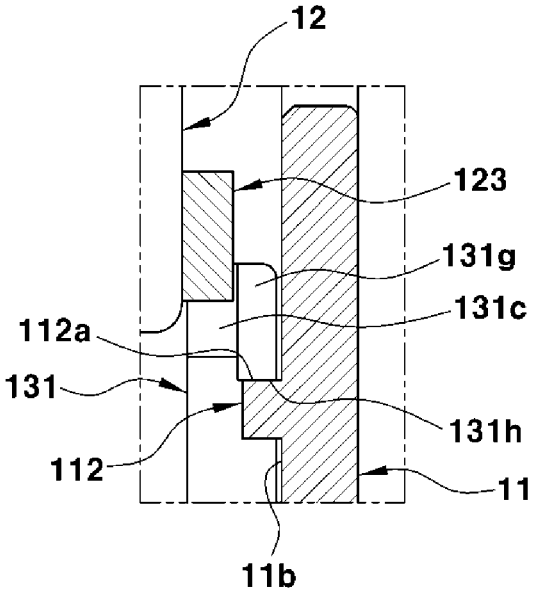
FIG. 10 is a diagram viewing the state just before a female housing is coupled to the male housing from the E-E direction of FIG. 7.
Figure 11:
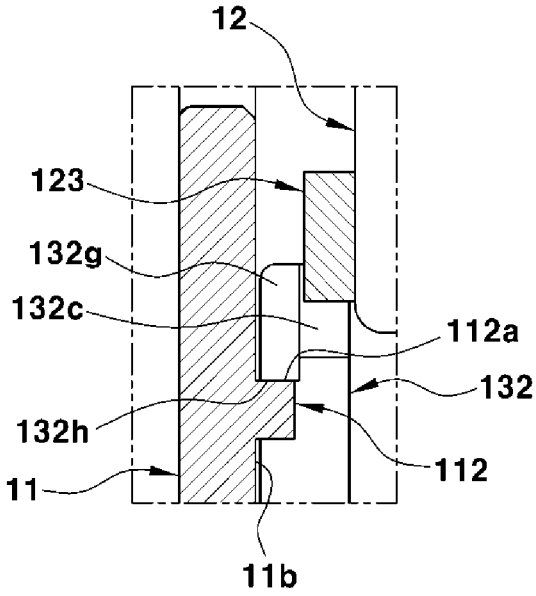
FIG. 11 is a diagram viewing the state just before the female housing is coupled to the male housing from the D-D direction of FIG. 7.

Referring to FIG. 9, the top portion of the moving cover lock 13*c* may be provided with an entry space 13*s* into which the bottom portion 123*d* of the female housing lock 123 may enter. The entry space 13*s* may be a space between the top portion of the first lock member 131 and the top portion of the second lock member 132. The entry space 13*s* may be a space where the bottom portion 123*d* of the female housing lock 123 may enter from before the first lock member 131 and the second lock member 132 are opened to both sides of the male housing lock 112. Specifically, the entry space 13*s* may be formed to be gradually narrowed in the insertion direction of the female housing 12. For example, the entry space 13*s* may be formed to have a substantially V-shaped section. For this purpose, the first lock member 131 and the second lock member 132 may be provided with a first inclined surface 131*c* and a second inclined surface 132*c* disposed at both sides of the entry space 13*s*, respectively. The female housing lock 123 bends the first lock member 131 and the second lock member 132 to both sides of the male housing lock 112 while riding on the first inclined surface 131*c* and the second inclined surface 132*c* to be slid between the first lock member 131 and the second lock member 132. That is, when the female housing lock 123 penetrates the entry space 13*s*, the first lock member 131 and the second lock member 132 are opened to both sides of the male housing lock 112. The first lock member 131 and the second lock member 132 may generate an elastic restoring force according to the degree of bending.

Figure 12:
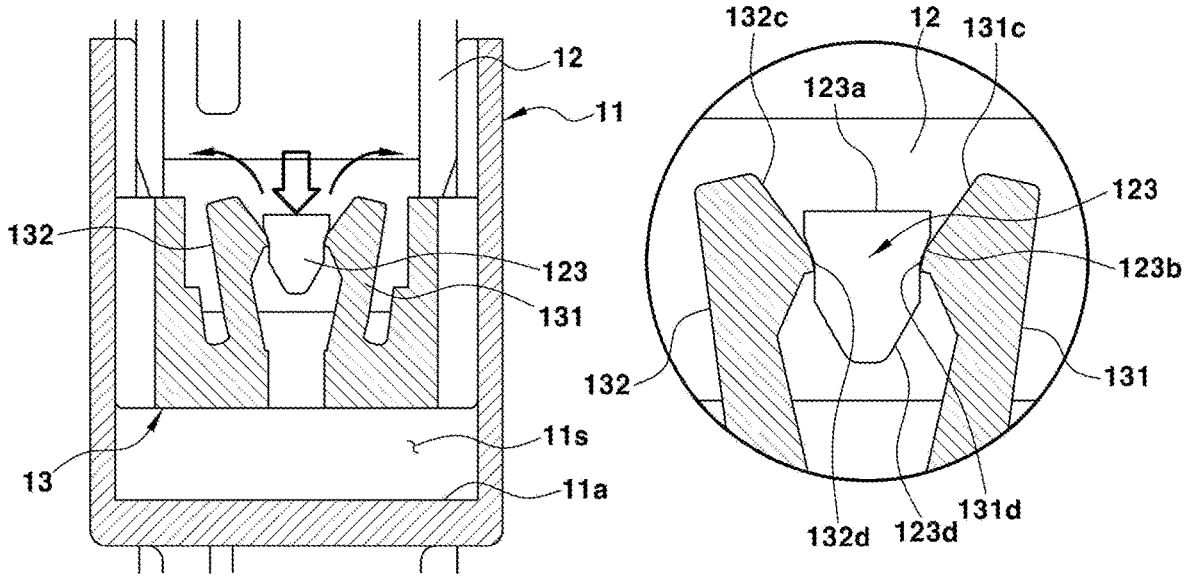
FIG. 12 is a diagram showing operation states of a female housing lock and a moving cover lock when the female housing is inserted into the male housing.

Referring to FIG. 12, when entering between the first lock member 131 and the second lock member 132, the female housing lock 123 may be pressed by the elastic restoring force of the first lock member 131 and the second lock member 132. Further, when the elastic restoring force becomes larger than the force that opens the first lock member 131 and the second lock member 132, the female housing lock 123 may be moved integrally with the moving cover lock 13*c*. For this purpose, the top portion of the female housing lock 123 may be provided with an extension 123*b*. The extension 123*b* may be formed to have a larger width than the bottom portion 123*d* of the female housing lock 123. For example, the extension 123*b* may be formed in the form of increasing its width in the direction in which the female housing 12 is separated. Specifically, the width of the extension 123*b* may be increased from the bottom portion 123*d* of the female housing lock 123 to the direction in which the female housing 12 is separated. The minimum width value of the extension 123*b* may be equal to the maximum width value of the bottom portion 123*d* of the female housing lock 123. The maximum width of the extension 123*b* may be larger than the maximum width of the entry space 13*s* by a certain value. As the extension 123*b* is provided, the female housing lock 123 is not slid between the first lock member 131 and the second lock member 132 and locked in a state fitted between the first lock member 131 and the second lock member 132. The female housing lock 123 is provided in the form of being protruded from the outside surface of the female housing 12. Accordingly, since the female housing lock 123 is fitted between the first lock member 131 and the second lock member 132 to be fixed thereto, the moving cover 13 may be moved toward the bottom surface 11*a* of the male housing 11 together with the female housing 12.

That is, when the extension 123*b* passes between the first lock member 131 and the second lock member 132, the elastic restoring force of the first lock member 131 and the second lock member 132 is larger than the force at which the female housing lock 123 presses the first lock member 131 and the second lock member 132, and accordingly, the female housing lock 123 may be moved integrally with the moving cover lock 13*c*. Since the extension 123*b* is fixed between the first lock member 131 and the second lock member 132, the female housing lock 123 is not slid between the first lock member 131 and the second lock member 132.

Specifically, the extension 123*b* may be fixed between the first lock member 131 and the second lock member 132 in a state having contacted a first vertical surface 131*d* and a second vertical surface 132*d*. That is, the first vertical surface 131*d* and the second vertical surface 132*d* may hold by pressing the extension 123*b* in a state having closely contacted the outside surface of the extension 123*b*. The outside surface of the extension 123*b* may be an inclined surface inclined at a certain angle with respect to the insertion direction of the female housing 12. Referring to FIG. 12, the first vertical surface 131*d* is disposed on the bottom of the first inclined surface 131*c* adjacent to the first inclined surface 131*c*, and the second vertical surface 132*d* is disposed at the bottom of the second inclined surface 132*c* adjacent to the second inclined surface 132*c*.

Figure 13:
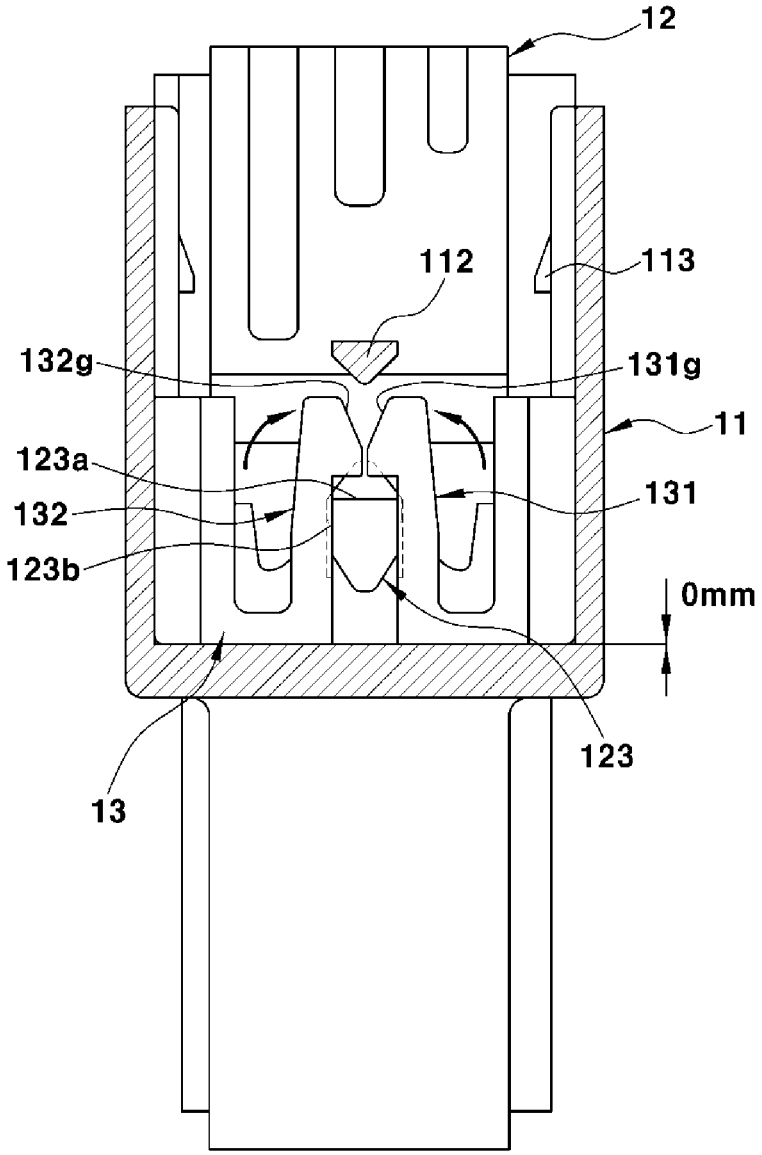
FIG. 13 is a diagram showing the states of the female housing lock and the moving cover lock when the female housing has been fully inserted into the male housing.

Referring to FIG. 13, if the moving plate 13*a* contacts the bottom surface 11*a* of the male housing 11 when the moving cover 13 is moved with the female housing 12, the female housing 12 lowers alone until contacting the moving plate 13*a*. At this time, the female housing lock 123 is disposed in a space between the bottom portion of the first lock member 131 (i.e., a first body portion) and the bottom portion of the second lock member 132 (i.e., a second body portion) while being separated from the moving cover lock 13*c*. Further, the first lock member 131 and the second lock member 132 are returned to their initial positions before they are bent by the female housing lock 123.

Figure 14:
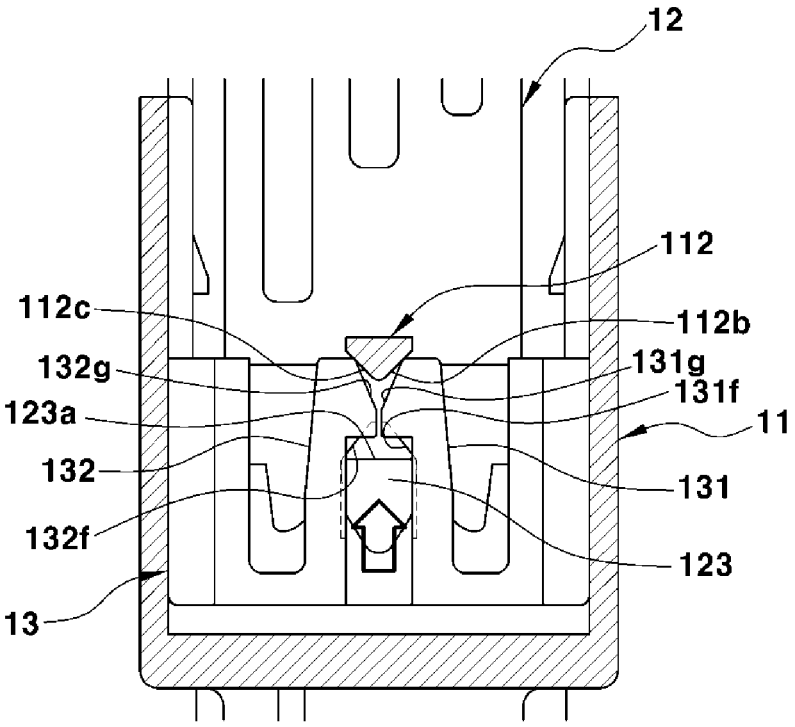
FIG. 14 is a diagram showing the states of the female housing lock and the moving cover lock when the female housing starts to be separated from the male housing.
Figure 15A:
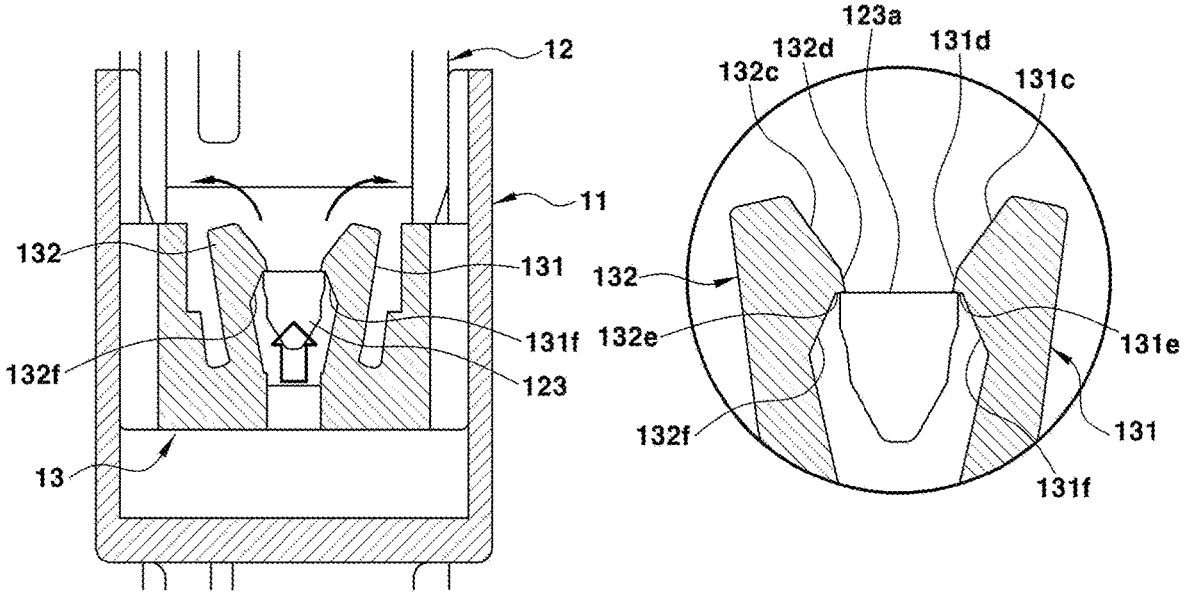
FIG. 15A is a diagram showing operation states of the female housing lock and the moving cover lock when the female housing is separated from the male housing.
Figure 15B:
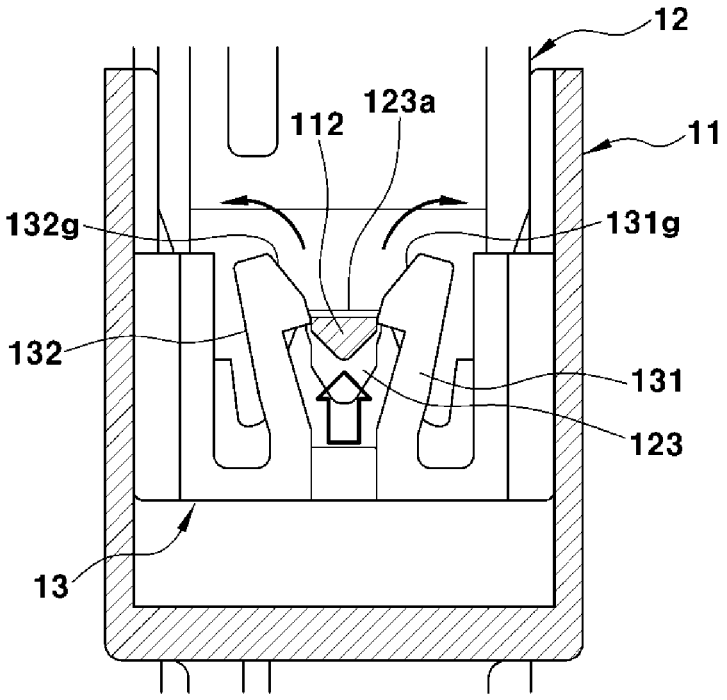
FIG. 15B is a diagram showing a state of the male housing lock when the female housing is separated from the male housing.

Meanwhile, referring to FIGS. 14 to 15B, when the female housing 12 moves and is lifted in the separating direction, the first lock member 131 and the second lock member 132 may be opened to both sides of the male housing lock 112 by the female housing lock 123. That is, when the female housing 12 is lifted, the first lock member 131 and the second lock member 132 are bent in the direction opposite to each other by the female housing lock 123. Accordingly, it is possible to prevent the lifting of the moving cover 13 from being restricted by the male housing lock 112.

For this operation, the first lock member 131 may be provided with a first lower inclined surface 131*f* that contacts the top horizontal surface 123*a* of the female housing lock 123. When the female housing 12 is moved in the direction separated from the male housing 11, the edge of the top horizontal surface 123*a* of the female housing lock 123 contacts the first lower inclined surface 131*f* The first lower inclined surface 131*f* may be formed to be inclined at a certain angle. Accordingly, the first lower inclined surface 131*f* may be pushed by the top horizontal surface 123*a* of the female housing lock 123 to be moved.

The second lock member 132 may be provided with a second lower inclined surface 132*f* that contacts the top horizontal surface 123*a* of the female housing lock 123. When the female housing 12 is separated from the male housing 11, the edge of the top horizontal surface 112*a* of the male housing lock 112 contacts the second lower inclined surface 132*f*. The second lower inclined surface 132*f* may be formed to be inclined at a certain angle, and accordingly, may be pushed by the top horizontal surface 123*a* of the female housing lock 123 to be moved. At this time, the female housing lock 123 pushes the first lower inclined surface 131*f* and the second lower inclined surface 132*f* to both sides of the female housing lock 123 while being slid along the first lower inclined surface 131*f* and the second lower inclined surface 132*f*. Referring to FIG. 15A, the first lower inclined surface 131*f* may be disposed below the first upper inclined surface 131*c* and the first vertical surface 131*d*, and the second lower inclined surface 132*f* may be disposed below the second upper inclined surface 132*c* and the second vertical surface 132*d*.

As described above, when the first lower inclined surface 131*f* and the second lower inclined surface 132*f* are pushed to both sides of the female housing lock 123, it is necessary to prevent the female housing lock 123 from being fully separated from the first lock member 131 and the second lock member 132. This is for allowing the moving cover 13 to be lifted together with the female housing 12. In order to allow the moving cover 13 to be lifted together with the female housing 12, the female housing lock 123 should maintain the state where the first lock member 131 and the second lock member 132 have been connected until the moving plate 13*a* reaches a right position. For this purpose, the first lock member 131 may be provided with a first latching part 131*e* latched to the top horizontal surface 123*a* of the female housing lock 123 when the female housing 12 is separated from the receiving space 11*s* of the male housing 11. The first latching part 131*e* may be disposed below the first upper inclined surface 131*c* and the first vertical surface 131*d* with respect to the insertion direction of the female housing 12. Further, the first latching part 131*e* may be disposed between the first vertical surface 131*d* and the first lower inclined surface 131*f*. The second lock member 132 may be provided with a second latching part 132*e* latched to the top horizontal surface 123*a* of the female housing lock 123 when the female housing 12 is separated from the male housing 11. The second latching part 132*e* may be disposed below the second upper inclined surface 132*c* and the second vertical surface 132*d* with respect to the insertion direction of the female housing 12. Further, the second latching part 132*e* may be disposed between the second vertical surface 132*d* and the second lower inclined surface 132*f*. The top horizontal surface 123*a* of the female housing lock 123 may be latched to the first latching part 131*e* and the second latching part 132*e* when the female housing 12 is slid in the direction separated from the male housing 11, thereby preventing the female housing lock 123 from being fully separated from the moving cover lock 13*c*. Accordingly, the moving cover 13 may move toward the top surface of the male housing 11 together with the female housing 12 by the force for separating the female housing 12 from the male housing 11.

Further, in order to prevent the moving cover lock 13*c* from interfering with the male housing lock 112 when the female housing 12 is separated from the male housing 11, the male housing lock 112 may be formed to have a substantially triangle-shaped section structure. At this time, a first bottom inclined surface 112*b* and a second bottom inclined surface 112*c* may be provided on the bottom portion of the male housing lock 112. The first bottom inclined surface 112*b* and the second bottom inclined surface 112*c* may be disposed below the top horizontal surface 112*a* of the male housing lock 112.

Figure 16:
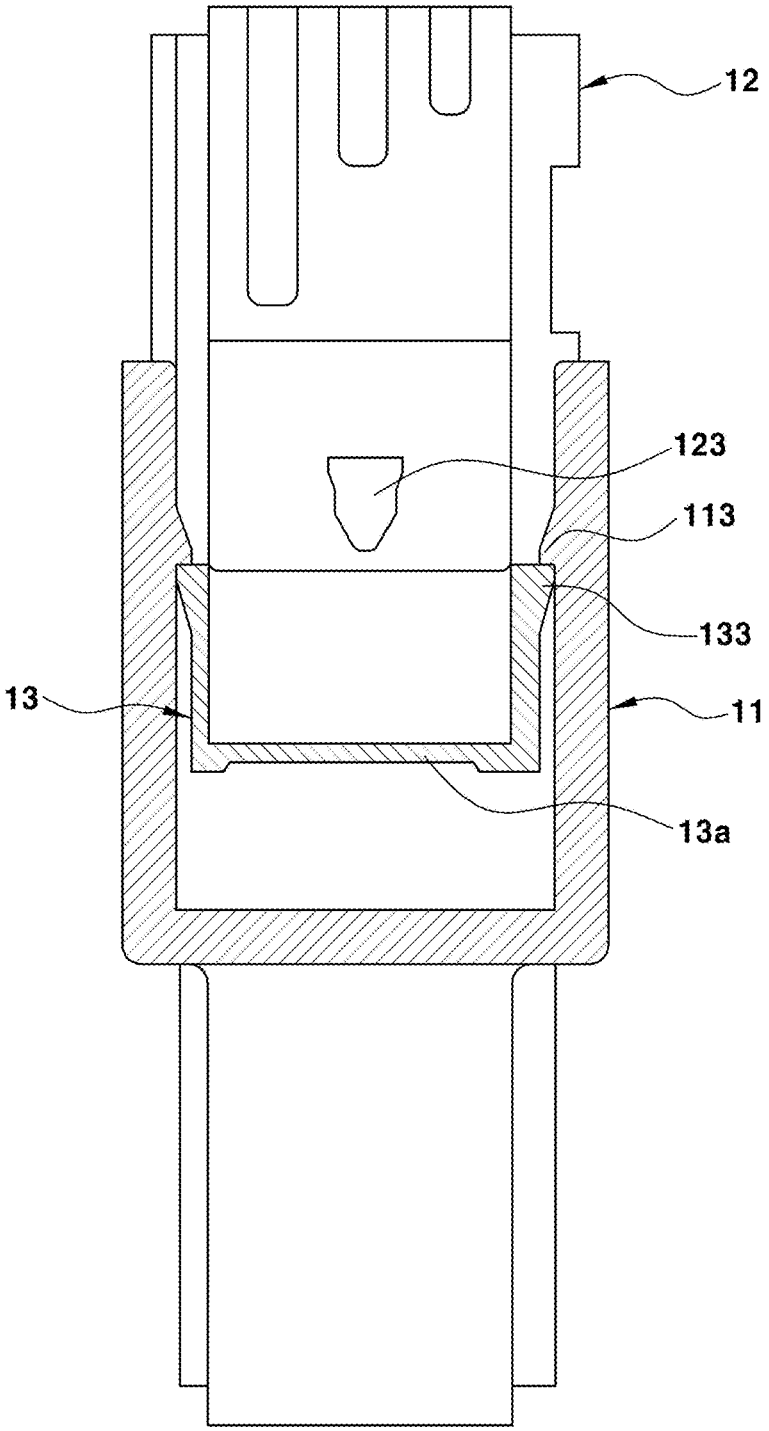
FIG. 16 is a diagram showing a structure for preventing the moving cover from being separated when the female housing is separated from the male housing.
Figure 17:
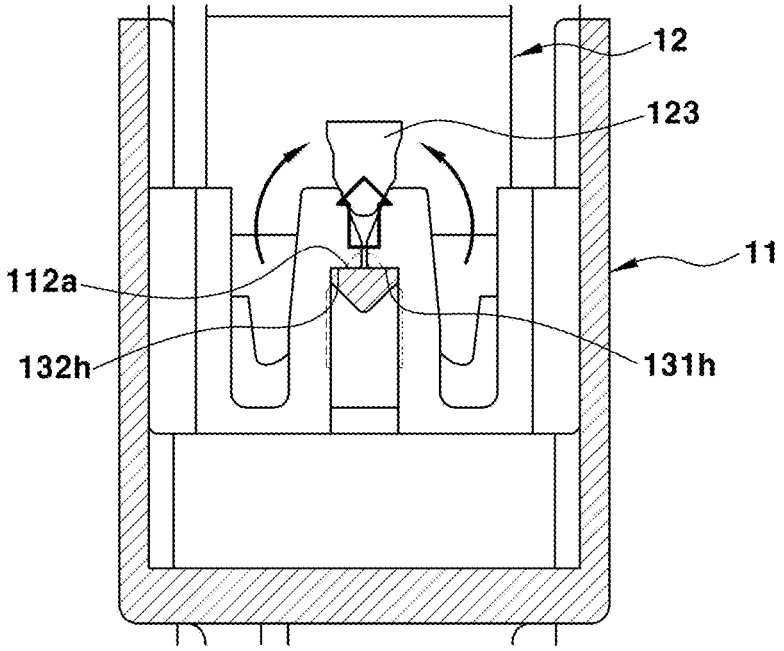
FIG. 17 is a diagram showing a state where the female housing lock has been separated from the moving cover lock and the moving cover lock has been returned when the female housing is separated from the male housing.

Referring to FIG. 16, when the moving cover 13 is lifted together with the female housing 12 to return to a predetermined position in the male housing 11, a separation preventing part 133 of the moving cover 13 is locked to a separation preventing projection 113 of the male housing 11. The separation preventing part 133 may be disposed to be formed integrally with the edge of the moving plate 13*a*, and disposed at the edge of the moving plate 13*a* where the moving cover lock 13*c* has not been disposed. The separation preventing projection 113 may be provided to be protruded from the inside surface of the male housing 11. The separation preventing part 133 is locked by the separation preventing projection 113, such that the lifting of the moving cover 13 is stopped and only the female housing 12 is slid in the direction separated from the male housing 11. At this time, the top horizontal surface 123*a* of the female housing lock 123 is separated from the first latching part 131*e* and the second latching part 132*e* of the moving cover lock 13*c* (see FIG. 17).

Referring to FIGS. 8 to 12, 15A, and 15B, in order to operate the male housing lock 112 and the female housing lock 123 as described above, the first lock member 131 and the second lock member 132 may be classified into a first section contacting the male housing lock 112 and a second section contacting the female housing lock 123 with respect to the thickness direction thereof, respectively. The thickness direction coincides with a direction in which the male housing lock 112 is protruded from the inside surface of the male housing 11 and a direction in which the female housing lock 123 is protruded from the outside surface of the female housing 12. The first sloped surface 131*g* and the first bottom horizontal surface 131*h* of the first lock member 131 is included in the first section disposed close to the inside surface of the male housing 11 of the inside surface of the male housing 11 and the outside surface of the female housing 12. Accordingly, the first sloped surface 131*g* and the first bottom horizontal surface 131*h* contact the male housing lock 112 and do not contact the female housing lock 123. The second sloped surface 132*g* and the second bottom horizontal surface 132*h* of the second lock member 132 is included in the first section disposed close to the inside surface 11*b* of the male housing 11 of the inside surface 11*b* of the male housing 11 and the outside surface of the female housing 12. Accordingly, the second sloped surface 132*g* and the second bottom horizontal surface 132*h* contact the male housing lock 112 and do not contact the female housing lock 123. Further, the first inclined surface 131*c*, the first vertical surface 131*d*, the first latching part 131*e*, and the first lower inclined surface 131*f* of the first lock member 131 is included in the second section disposed close to the outside surface of the female housing 12 of the inside surface 11*b* of the male housing 11 and the outside surface of the female housing 12. Accordingly, the first inclined surface 131*c*, the first vertical surface 131*d*, the first latching part 131*e*, and the first lower inclined surface 131*f* contact the female housing lock 123 and do not contact the male housing lock 112. The second inclined surface 132*c*, the second vertical surface 132*d*, the second latching part 132*e*, and the second lower inclined surface 132*f* of the second lock member 132 is included in the second section disposed close to the outside surface of the female housing 12 of the inside surface 11*b* of the male housing 11 and the outside surface of the female housing 12. Accordingly, the second inclined surface 132*c*, the second vertical surface 132*d*, the second latching part 132*e*, and the second lower inclined surface 132*f* contact the female housing lock 123 and do not contact the male housing lock 112.

Meanwhile, the first lock member 131 may be classified by a first body part 131*a* of a bar shape formed integrally at the edge of the moving plate 13*a*, and a first head part 131*b* formed integrally with the upside of the first body part 131*a*. Further, the second lock member 132 may be classified by a second body part 132*a* of a bar shape formed integrally at the edge of the moving plate 13*a*, and a second head part 132*b* formed integrally at the upside of the second body part 132*a*. The first section and the second section described above may be provided in the first head part 131*b* and the second head part 132*b*. The first section of the first lock member 131 may be provided with the first sloped surface 131*g* and the first bottom horizontal surface 131*h*. The first sloped surface 131*g* may contact the first bottom inclined face 112*b* of the male housing lock 112 when the female housing 12 is separated from the male housing 11. The first bottom horizontal surface 131*h* supports the top horizontal surface 112*a* of the male housing lock 112 when the female housing 12 is not coupled with the male housing 11. The second section of the first lock member 131 may be provided with the first inclined surface 131*c*, the first vertical surface 131*d*, the first latching part 131*e*, and the first lower inclined surface 131*f*. The bottom portion 123*d* of the female housing lock 123 is slid by contacting the first inclined surface 131*c* when the female housing 12 is coupled with the male housing 11. The top horizontal surface 123*a* of the female housing lock 123 is locked by contacting the first latching part 131*e* when the female housing 12 is separated from the male housing 11. Further, the top horizontal surface 123*a* of the female housing lock 123 contacts the first lower inclined surface 131*f* when the female housing 12 is separated from the male housing 11, such that the first lock member 131 may be pushed by the female housing lock 123 to be bent to the opposite side of the second lock member 132. The first section of the second lock member 132 may be provided with the second sloped surface 132*g* and the second bottom horizontal surface 132*h*. The second sloped surface 132*g* may contact the second bottom inclined surface 112*c* of the male housing lock 112 when the female housing 12 is separated from the male housing 11. The second bottom horizontal surface 132*h* supports the top horizontal surface 112*a* of the male housing lock 112 when the female housing 12 is not coupled with the male housing 11. The second section of the second lock member 132 may be provided with the second inclined surface 132*c*, the second vertical surface 132*d*, the second latching part 132*e*, and the second lower inclined surface 132*f*. The bottom portion 123*d* of the female housing lock 123 is slid by contacting the second inclined surface 132*c* when the female housing 12 is inserted into the male housing 11. The top horizontal surface 123*a* of the female housing lock 123 is locked by contacting the second latching part 132*e* when the female housing 12 is separated from the male housing 11. Further, the top horizontal surface 123*a* of the female housing lock 123 contacts the second lower inclined surface 132*f* when the female housing 12 is separated from the male housing 11, such that the second lock member 132 may be pushed by the female housing lock 123 to be bent to the opposite side of the first lock member 131. When the female housing 12 is lifted in the male housing 11, the top horizontal surface 123*a* of the female housing lock 123 pushes the first lock member 131 and the second lock member 132 to both sides of the female housing lock 123 after contacting the first lower inclined surface 131*f* and the second lower inclined surface 132*f*.

The male housing lock 112 contacts only the first section of the first lock member 131 and the second lock member 132 and does not contact the second section of the first lock member 131 and the second lock member 132. The female housing lock 123 contacts only the second section of the first lock member 131 and the second lock member 132 and does not contact the first section of the first lock member 131 and the second lock member 132. For this purpose, a gap may be present between the male housing lock 112 and the female housing lock 123. Accordingly, when the female housing 12 is coupled to the male housing 11 or when the female housing 12 is separated from the male housing 11, the male housing lock 112 and the female housing lock 123 are not locked to each other.

Figure 2:
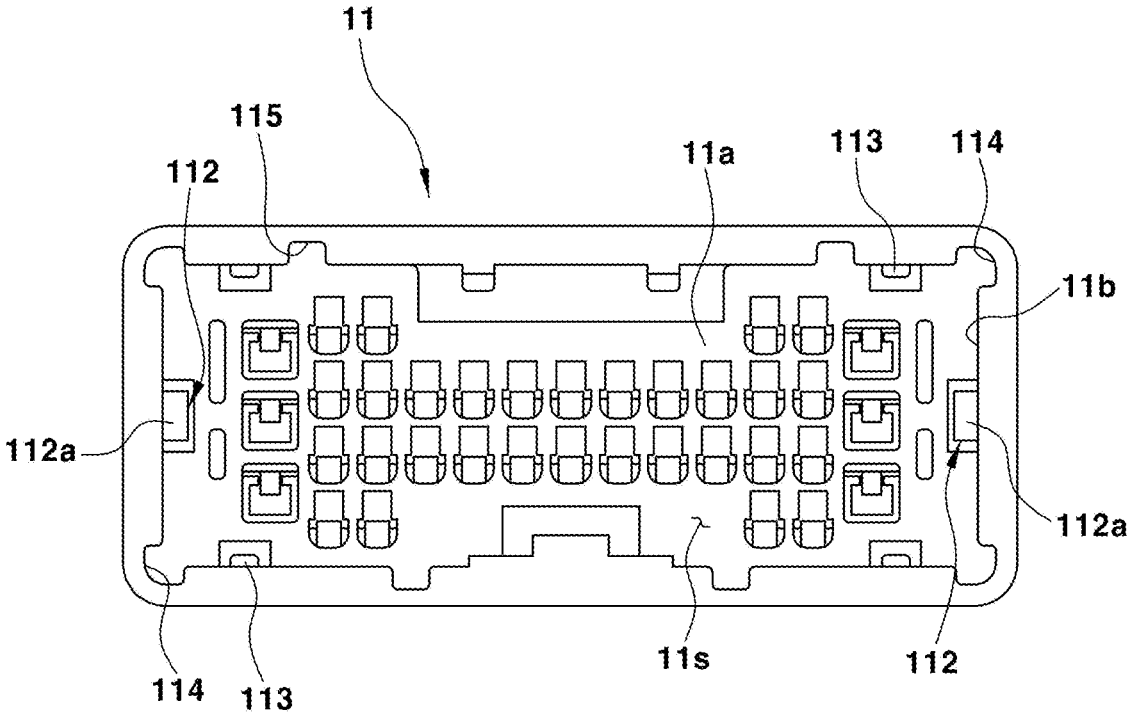
FIG. 2 is a plane diagram showing a male housing according to the present disclosure.
Figure 3:
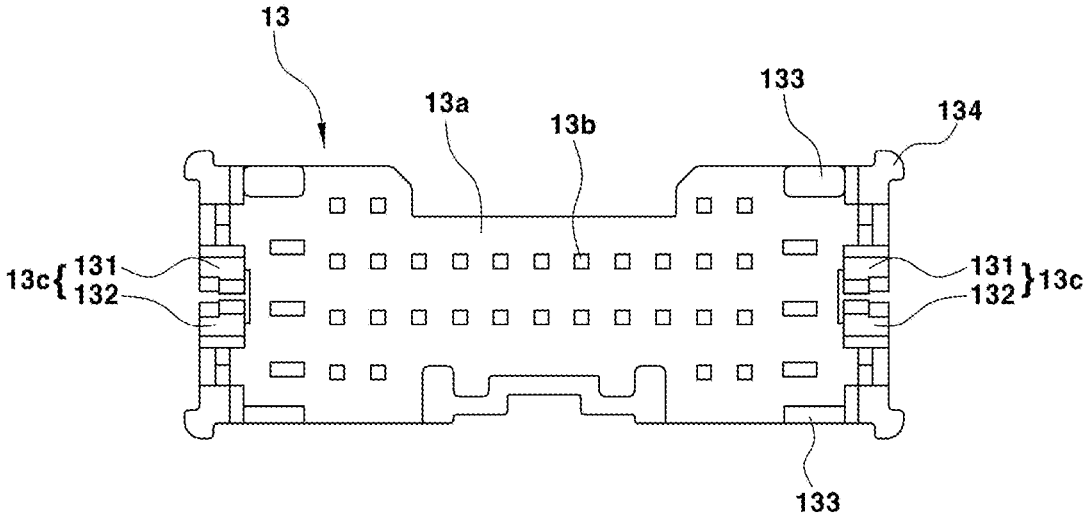
FIG. 3 is a plane diagram showing a moving cover according to the present disclosure.
Figure 4:
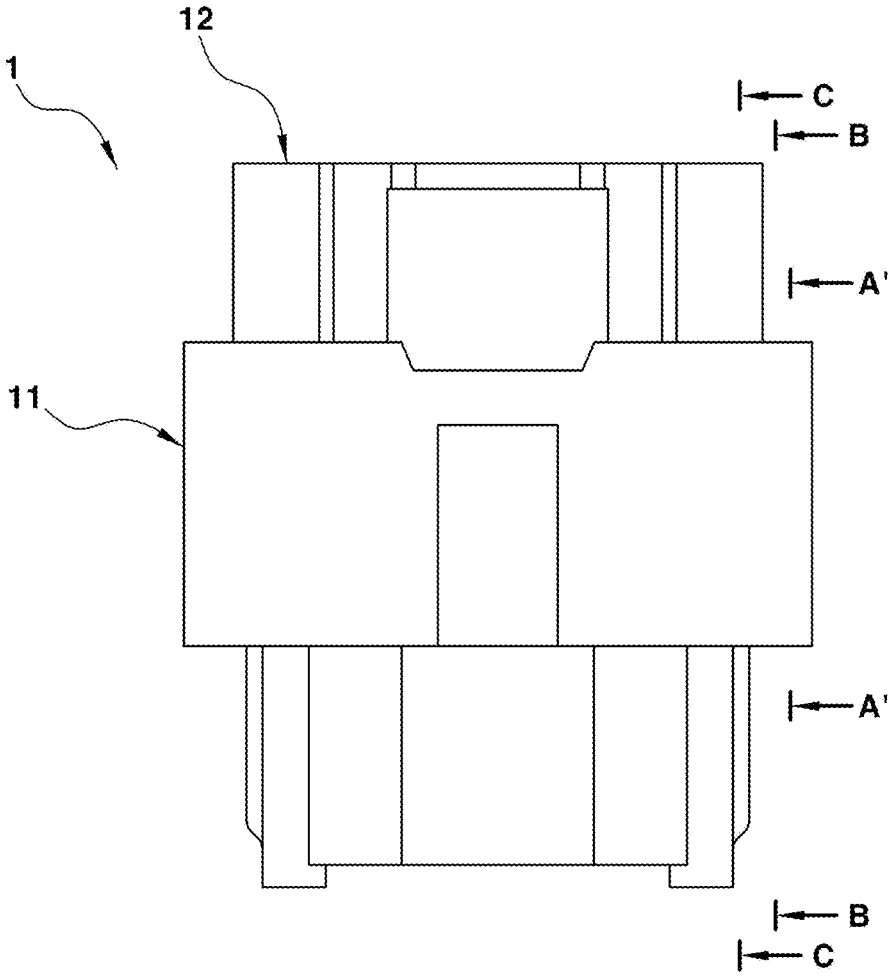
FIG. 4 is a coupling diagram showing the connector according to the present disclosure.

Meanwhile, referring to FIGS. 1 to 3, the male housing 11 may be provided with a first guide groove 114 for guiding the sliding of the moving cover 13. The moving cover 13 may be provided with a first guide bar 134 that is slidably assembled in the first guide groove 114. The moving cover 13 may be stably slid in the male housing 11 by the first guide groove 114 and the first guide bar 134. The first guide groove 114 may be disposed on the inside surface 11*b* of the male housing 11. The first guide bar 134 may be disposed at the edge of the moving cover 13.

Further, the male housing 11 may be provided with a second guide groove 115 for guiding the sliding of the female housing 12. The female housing 12 may be provided with a second guide bar 124 that is slidably assembled in the second guide groove 115. The female housing 12 may be slid by the second guide groove 115 and the second guide bar 124 in the male housing 11 without shaking. The second guide groove 115 may be disposed on the inside surface 11*b* of the male housing 11. The second guide bar 124 may be disposed on the outside surface of the female housing 12.

As described above, although an embodiment of the present disclosure has been described in detail, the scope of the present disclosure is not limited to the above-described embodiment, and various deformations and improvements of those skilled in the art using the basic concept of the present disclosure defined in the appended claims are also included in the scope of the present disclosure.

The invention claimed is:

1. A terminal protection device of a connector, comprising:

a moving cover provided with a moving cover lock, and assembled at a predetermined position of a male housing to support male terminals disposed in a receiving space of the male housing;

a male housing lock provided in the male housing, and for preventing the moving cover from being moved in the insertion direction of a female housing at the predetermined position of the male housing by supporting the moving cover lock when the female housing is not inserted into the receiving space; and a female housing lock provided in the female housing, and the moving cover is moved by the male housing lock by separating the moving cover lock from the male housing lock;

wherein the moving cover lock is locked to the female housing lock to be moved with the female housing lock when the female housing is separated from the receiving space, such that the moving cover returns to the predetermined position;

wherein the moving cover comprises:

a moving plate provided with a plurality of through holes that the male terminals penetrate; and a moving cover lock provided in the moving plate, and contacting a top horizontal surface of the male housing lock when the moving plate is disposed at a predetermined position;

wherein the moving cover lock comprises:

a first lock member formed integrally on the moving plate; and a second lock member formed integrally on the moving plate, and in line with the first lock member; and wherein the female housing is pushed by the female housing lock entering between the first lock member and the second lock member when being inserted into the receiving space, such that the first lock member and the second lock member are separated from the top horizontal surface of the male housing lock.

2. The terminal protection device of the connector of claim 1, wherein the first lock member is provided with a first inclined surface pushed while contacting the bottom portion of the female housing lock when the female housing is inserted into the receiving space; and wherein the second lock member is provided with a second inclined surface pushed while contacting the bottom portion of the female housing lock when the female housing is inserted into the receiving space.

3. The terminal protection device of the connector of claim 2, wherein the first lock member is provided with a first latching part to which the top horizontal surface of the female housing lock is latched when the female housing is separated from the receiving space, and the first latching part is disposed below the first inclined surface with respect to the insertion direction of the female housing; and wherein the second lock member is provided with a second latching part to which the top horizontal surface of the female housing lock is latched when the female housing is separated from the receiving space, and the second latching part is disposed below the second inclined surface with respect to the insertion direction of the female housing.

4. The terminal protection device of the connector of claim 3, wherein the first lock member is provided with a first lower inclined surface pushed by contacting the top horizontal surface of the female housing lock when the female housing is separated from the receiving space, and the first lower inclined surface is disposed below the first latching part; and wherein the second lock member is provided with a second lower inclined surface pushed by contacting the top horizontal surface of the female housing lock when the female housing is separated from the receiving space, the second lower inclined surface is disposed below the second latching part, and the second lower inclined surface is pushed in the direction opposite to the first lower inclined surface.

5. The terminal protection device of the connector of claim 4, wherein the first inclined surface, the first latching part, and the first lower inclined surface are disposed close to the outside surface of the female housing of the inside surface of the male housing and the outside surface of the female housing to contact the female housing lock protruded to the outside surface of the female housing and not to contact the male housing lock protruded to the inside surface of the male housing.

6. The terminal protection device of the connector of claim 4, wherein the second inclined surface, the second latching part, and the second lower inclined surface are disposed close to the outside surface of the female housing of the inside surface of the male housing and the outside surface of the female housing to contact the female housing lock protruded to the outside surface of the female housing and not to contact the male housing lock protruded to the inside surface of the male housing.

7. The terminal protection device of the connector of claim 2, wherein the top portion of the female housing lock is provided with an extension having the width larger than that of the bottom portion of the female housing lock, and wherein the extension is locked between the first lock member and the second lock member by an elastic restoring force of the first lock member and the second lock member bent by being pushed by the bottom portion of the female housing lock when the female housing is inserted into the receiving space.

8. The terminal protection device of the connector of claim 1, wherein the first lock member is provided with a first bottom horizontal surface locked to the top horizontal surface of the male housing lock when the female housing is not inserted into the receiving space; and wherein the second lock member is provided with a second bottom horizontal surface locked to the top horizontal surface of the male housing lock when the female housing is not inserted into the receiving space.

9. The terminal protection device of the connector of claim 8, wherein the first bottom horizontal surface is disposed close to the inside surface of the male housing of the inside surface of the male housing and the outside surface of the female housing to contact the male housing lock protruded to the inside surface of the male housing and not to contact the female housing lock protruded to the outside surface of the female housing.

10. The terminal protection device of the connector of claim 8, wherein the second bottom horizontal surface is disposed close to the inside surface of the male housing of the inside surface of the male housing and the outside surface of the female housing to contact the male housing lock protruded to the inside surface of the male housing and not to contact the female housing lock protruded to the outside surface of the female housing.

11. The terminal protection device of the connector of claim 1, wherein the inside surface of the male housing is provided with a separation preventing projection, and a separation preventing bar locked to the separation preventing projection when the moving cover returns to a predetermined position is provided at the edge of the moving plate.

* * * * *